US006676293B2

(12) United States Patent
Ferris

(10) Patent No.: US 6,676,293 B2
(45) Date of Patent: Jan. 13, 2004

(54) VINYL WICKET BAG

(75) Inventor: Neal Patrick Ferris, Charlotte, NC (US)

(73) Assignee: IMEX Discovery Resources, Inc., Charlotte, NC (US)

( * ) Notice: Subject to any disclaimer, the term of this patent is extended or adjusted under 35 U.S.C. 154(b) by 38 days.

(21) Appl. No.: 09/946,883

(22) Filed: Sep. 5, 2001

(65) Prior Publication Data

US 2003/0041567 A1 Mar. 6, 2003

(51) Int. Cl.[7] ..... B65D 33/14

(52) U.S. Cl. ..... 383/67; 383/66; 383/107; 383/97; 53/418; 53/138.5; 53/572

(58) Field of Search ..... 383/67, 107, 66, 383/97; 53/459, 418, 138.5, 572

(56) References Cited

U.S. PATENT DOCUMENTS

| | | | | | |
|---|---|---|---|---|---|
| 3,078,897 | A | * | 2/1963 | Rifkin | 383/40 |
| 3,338,398 | A | | 8/1967 | Altman, Jr. | 206/57 |
| 3,468,100 | A | | 9/1969 | Rubel | 53/189 |
| 3,646,726 | A | | 3/1972 | Hutcheson | 53/29 |
| 3,770,134 | A | | 11/1973 | Kupcikevicius | 211/57 |
| 3,777,930 | A | | 12/1973 | Ericson et al. | 221/26 |
| 3,802,157 | A | | 4/1974 | Elms et al. | 53/385 |
| 4,262,803 | A | | 4/1981 | Nausedas et al. | 206/554 |
| 4,277,930 | A | | 7/1981 | Nausedas et al. | 53/396 |
| 4,519,504 | A | | 5/1985 | Nausedas | 206/554 |
| 4,541,226 | A | | 9/1985 | Nausedas | 53/459 |
| 4,542,824 | A | * | 9/1985 | Allen | 206/287.1 |
| 4,669,251 | A | | 6/1987 | Inagaki | 53/385 |
| 5,181,610 | A | * | 1/1993 | Quick et al. | 206/447 |
| 5,782,562 | A | * | 7/1998 | Anspacher | 383/15 |
| 5,853,247 | A | * | 12/1998 | Shroyer | 383/95 |
| 5,961,034 | A | * | 10/1999 | deMunnik et al. | 229/87.19 |
| 6,019,512 | A | * | 2/2000 | Yeager | 383/203 |
| 6,068,128 | A | | 5/2000 | Garadner | 206/554 |

* cited by examiner

*Primary Examiner*—Rinaldi I. Rada
*Assistant Examiner*—Brian D Nash
(74) *Attorney, Agent, or Firm*—McNair Law Firm, P.A.

(57) ABSTRACT

A packaging bag having a body portion with opposed sides, a bottom and a top formed of a pair of synthetic sheets. The sides of the bag are formed by securing the overlying edges of the synthetic sheets together by stitching. The bottom is formed by securing bottom edges of the synthetic sheets together with a heat sealed seam and the top is formed to include a panel of a re-sealable member secured with the top edge of each of the synthetic sheets. The opposed edges of the panels are releasable engagable providing a bag which is selectively opened and closed.

9 Claims, 4 Drawing Sheets

VINYL WICKET BAG

BACKGROUND OF THE INVENTION

This invention is directed to a method of forming and filling a wicket bag and the bag.

Wicket bags such as those shown in U.S. Pat. Nos. 4,262,803; 3,770,134; 3,777,930; 3,802,157 as well as the methods of filling them are well-known throughout the packaging industry. As illustrated in the referred to patents, these bags are formed of very thin plastic sheets or plastic film with no seams or with heat sealed seams. They are not re-usable bags in that they must be torn in order to retrieve the packaged item.

The instant application is directed to re-usable wicket bags formed of comparatively heavy vinyl sheets which are designed to package more expensive durable goods.

Known vinyl packaging bags designed for use in the packaging area of the invention, which is primarily retail display bags are now formed to have a body portion consisting of a pair of vinyl sheets sewn together along opposed sides and the bottom to define the enclosed area of the bag. The bag top is equipped with a zipper forming it to be re-closable. The bag is filled at the top through the open zipper in the manner shown in FIG. 3. After filling, the zipper is actuated to close the top. Obviously, this manner of filling bags is very time consuming.

Accordingly, it is a primary object of the invention to provide a display bag which is capable of being quickly filled.

Another object of the invention is the provision of a re-usable wicket bag.

It is another object of the instant invention to provide a wicket bag having a top which is re-closable.

Another object is to provide a wicket bag formed of vinyl sheets.

Another object of the invention is the provision of a wicket bag having stitched sides and a sealed bottom.

Another object of the invention is the provision of a wicket bag in which the bagged product is inserted into the bag from the bottom and removed from the top.

Another object of the invention is to provide a vinyl wicket bag for use with known packaging machines.

SUMMARY OF THE INVENTION

The instant invention is directed to a packaging bag formed of superimposed vinyl or other suitable material sheets which form the bag to have a body portion with opposed sides, a bottom and a top. The sides are formed by stitching the overlying edges of the superimposed sheets together with a synthetic thread, preferably nylon. The bottom of the bag body is formed by adhering together the upper and lower sheets along lower edges thereof preferably with a heat seal. The body top includes a zipper with its zipper panels secured with upper edges of the vinyl sheets to form an upper edge which is openable and closable.

Preferably a pair of heat sealed seams are provided at the bottom. The seams extend transversely through each stitched edge with the stitching thread being cut at the seam.

Preferably the plastic is clear.

The invention includes a wicket packing bag in which preferably clear upper and lower plastic sheets form the body portion which includes a top, first and second sides and a bottom. The plastic sheets are interconnected at the top with a re-sealable member, preferably a zipper, forming the top to be selectively openable or closable. The sides are formed by stitching edge portions of the sheets along the length of the body.

The bottom is formed with the transverse lower edge of the upper sheet terminating short of the transverse lower edge of the lower sheet forming a tab in which a pair of wicket holes are formed adjacent its lower corners.

A hanger may or may not be connected with the top portion of the bag. Also, preferably the stitching thread is nylon although other synthetic threads with a proper melt temperature are acceptable.

Additionally, the invention includes the method of forming and filling a wicket bag including overlaying synthetic sheets and securing upper edges thereof with a re-closable member such as a zipper. Interconnecting opposed side edges of the sheets by stitching to form a bag interior. Positioning lower edges of the plastic sheets in longitudinally spaced positions with the lower sheet extending beyond the upper sheet forming an opening into the bag interior. Forming wicket holes in the lower sheet extension.

The method further includes connecting the wicket holes with a wicket and locating it in a packing position. Causing an air current to pass through the open end into the bag interior expanding the bag. Inserting a item into the bag interior and sealing the lower end of the bag. Removing the lower extension from the filled bag.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figures 1, 1A:
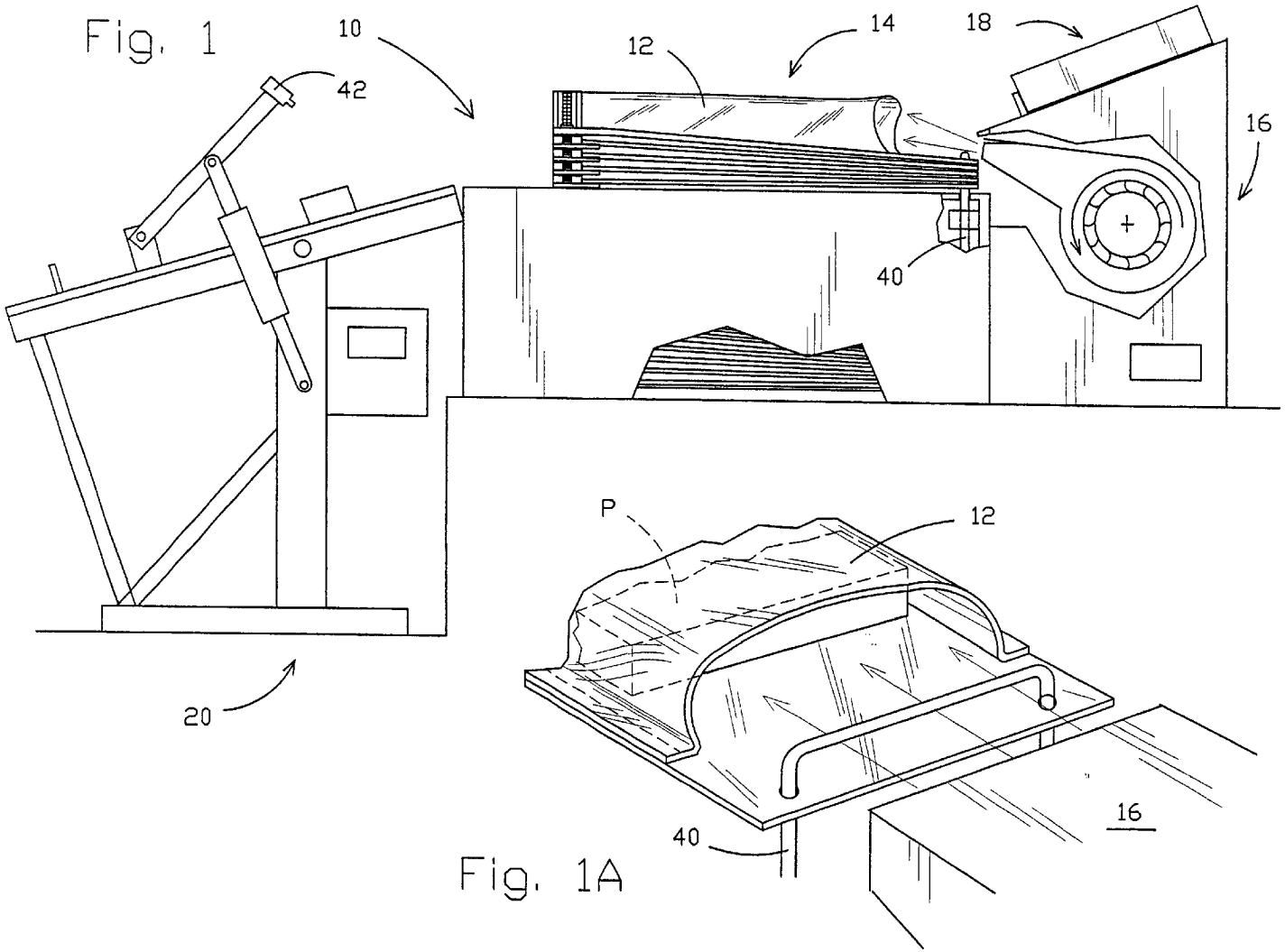
FIG. 1 is a schematic side view of a packaging arrangement utilizing the zipper wicket bag of the invention.
FIG. 1*a* is an exploded sectional view of the wicket bag in opened position for receiving an article.

Referring to the drawings, the invention wilt now be described in more detail.

FIG. 1 shows generally a packaging machine 10 of the type with which the wicket packaging bags 12 of the invention may be used. Machine 10 includes the receiving area 14 which holds bags 12 successively in position to be filled with product, a blower assembly 15, a product feed assembly 18, and the sealing assembly 20.

This packaging assembly is only illustrative and other packaging arrangements may be used equally well with the wicket bag of the invention.

Figure 2:
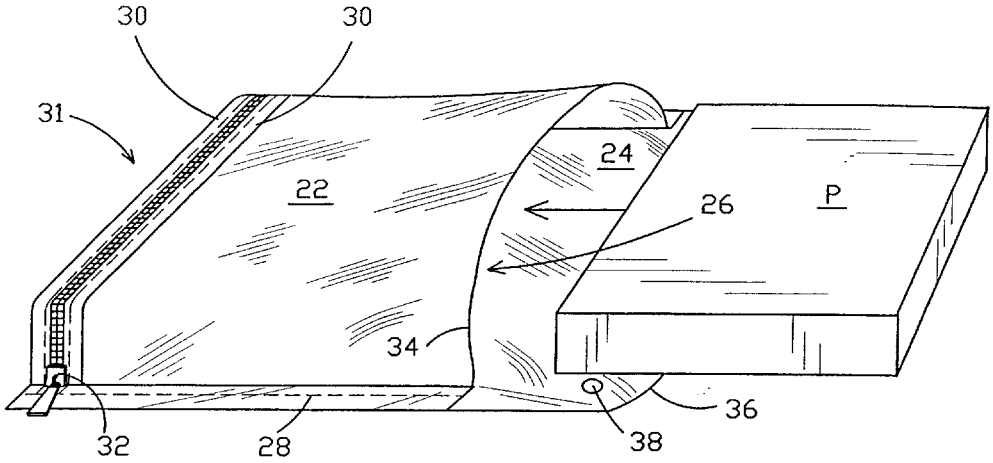
FIG. 2 is a diagrammatic view of an article in position for insertion into the lower end of the wicket bag of the invention.
Figure 3:
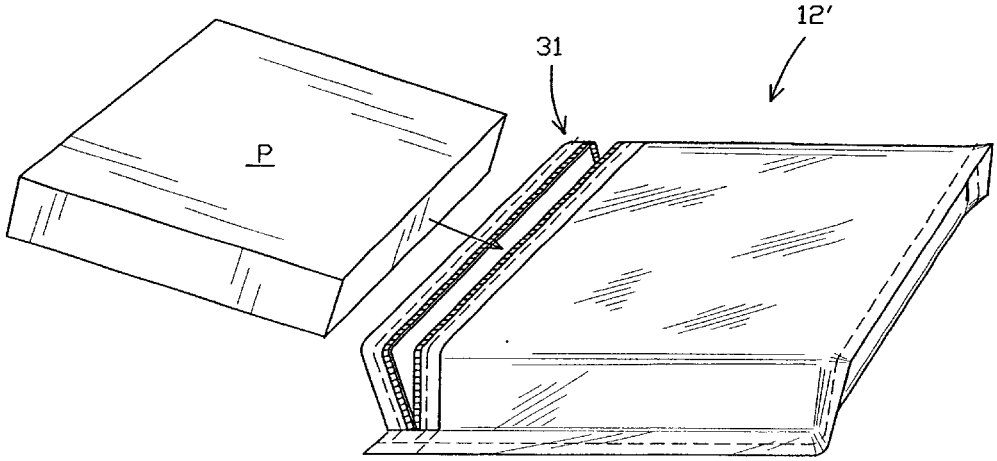
Fig. 3 PRIOR ART
FIG. 3 is a diagrammatic view of the known manner of article insertion into a zippered vinyl bag.
Figure 4:
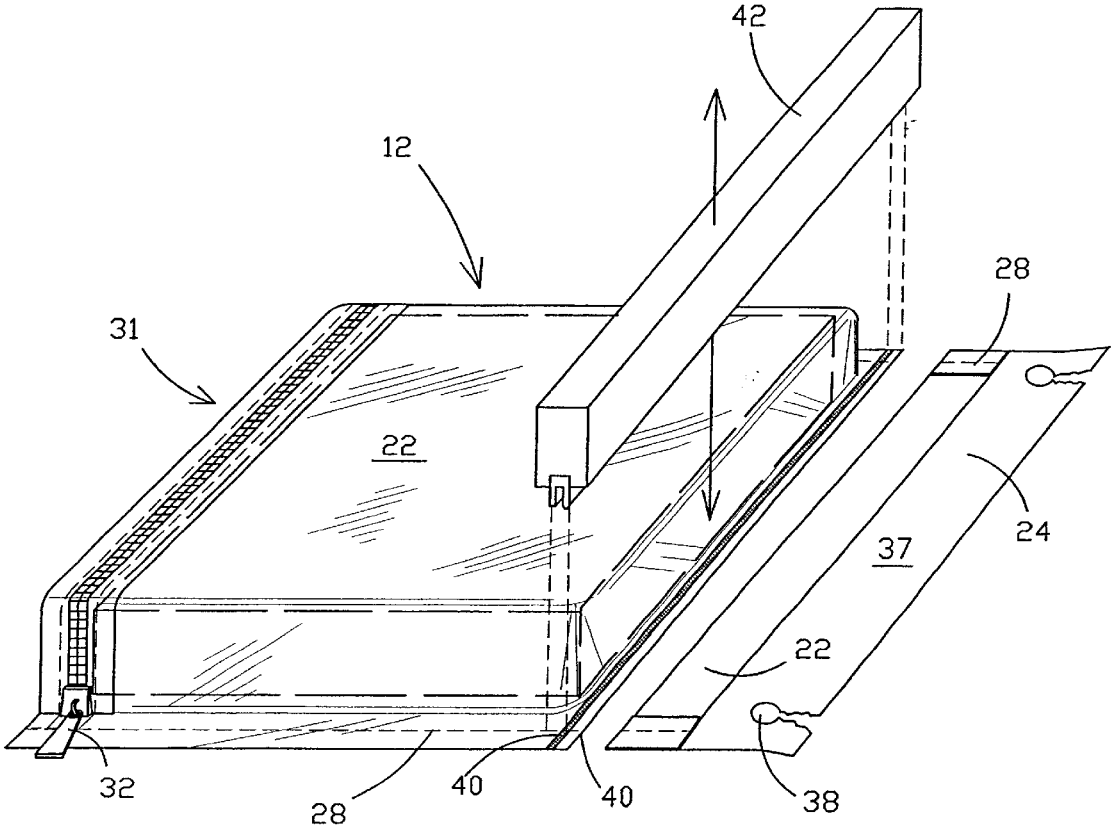
FIG. 4 is a diagrammatic perspective view of a heater bar with heat sealing elements for sealing the lower end of the filled bag.
Figure 5:
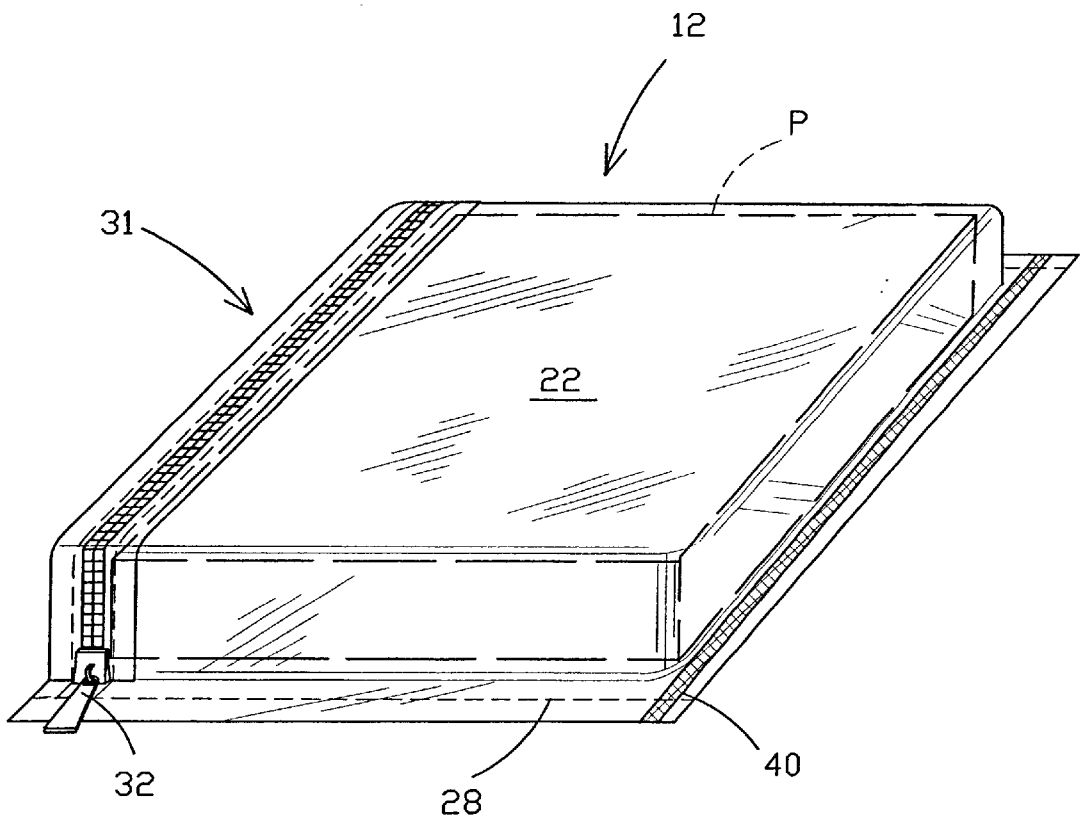
FIG. 5 is a perspective view of the zippered wicket bag with the lower end sealed.

Turning now to FIGS. 2, 4 and 5, wicket bag 12 is formed of two superimposed vinyl plastic or synthetic sheets 22, 24. In the arrangement shown, top sheet 22 is slightly wider but shorter than bottom sheet 24. This is to accommodate an expanded bag interior 26 as best shown in FIG. 2. Synthetic sheets are sewn or stitched along opposed outer edges of the synthetic sheets forming seams 28. The outer edges of each sheet remain outwardly of the interior of the bag. Nylon thread is preferably used. Top edges of synthetic sheets 22, 24 each have a binder strip 30 stitched thereto across their entire length the binder strip being outward of the interior of the bag. Inner faces of the binder strips contain teeth and receive a slide forming zipper 31. Zipper 31 forms the upper end of bag 12 to be easily opened and re-closable.

The lower end of bag 12 is formed with lower edge 34 of top sheet 22 positioned longitudinally short of end 36 of lower sheet 24 forming flap 37. Adjacent opposed corners of flap 37 are provided wicket receiving holes 38.

The finished construction of bag 12 includes edge 34 of upper synthetic sheet being brought down into contact with the upper face of flap 37 and sealed there to with a pair of sealing wires or elements 40. Along the outer seal line the remainder of flap 37 along with a slight excess of upper sheet 22 is cut away as best shown in FIGS. 4 and 5. It is noted that seal lines 40 along with the exposed lower edges of sheets 22 and 24 remain outward of interior 26 and extend perpendicular of and through seams 28 with the sealing wire also severing the stitching thread forming a finished edge.

The primary use for bag 12 is as a display bag for retail items such as blankets, towels, linens, bed spreads, etc. Obviously, other products could be equally well displayed.

In practice the method includes mounting a plurality bag 12 on wicket 40 and positioning the wicket in receiving area 14 of machine 10. Blower assembly 16 delivers air against the open end of bag 12 causing upper sheet 22 to elevate above sheet 24 exposing bag interior 26. Package P is moved from feed assembly and inserted into interior 26 of bag 12. Bag 12 is now removed from receiving area 14 onto sealing assembly 20. Sealing bar 42 is brought down into engagement with upper sheet 22 bringing it into contact with lower sheet 24, forming transverse seals 40 and severing a small portion adjacent edge 34 of upper sheet 22 and the remainder of flap 37.

The bag containing the product is removed for shipment.

While a preferred embodiment of the invention has been described using specific terms, such description is for illustrative purposes only, and it is to be understood that changes and variations may be made without departing from the spirit or scope of the following claims.

What is claimed is:

1. A packaging bag formed of a pair of synthetic sheets comprising:

a body portion having an interior, opposed sides, a bottom and a top;

said sides being formed of overlying side edges of said synthetic sheets secured together by stitching said side edges remaininig outwardly of said interior side;

said bottom being formed of overlying bottom edges of said synthetic sheets secured together by at least one heat seal seam said bottom edges remaining outwardly of said interior; and said top being formed to include a panel of a re-sealable member secured with a top edge of each said synthetic sheets with adjacent edges of said panels being releasable engagable; whereby, said bag may be selectively opened and closed by sealing and unsealing said member.

2. The bag of claim 1 wherein said stitching utilizes a synthetic thread.

3. The bag of claim 2 wherein said heat seal seam comprises a pair of heat seal seams.

4. The bag of claim 2 wherein said thread is severed at said seam.

5. The bag of claim 1 wherein said heat seal seam extends substantially transversely through a longitudinal axis formed by said stitching to said side edges.

6. The bag of claim 1 including a hanger attached to said top.

7. The bag of claim 1 wherein said synthetic sheets comprise one of polyvinyl chloride, polyethylene and polypropylene.

8. The bag of claim 1 wherein at least one of said synthetic sheets is clear.

9. The bag of claim 1 wherein said re-sealable member comprises a zipper.

* * * * *